US010029257B2

(12) United States Patent
Prakash et al.

(10) Patent No.: US 10,029,257 B2
(45) Date of Patent: Jul. 24, 2018

(54) SYNCHRONOUS UNIVERSAL DROPLET LOGIC

(71) Applicant: The Board of Trustees of the Leland Stanford Junior University, Palo Alto, CA (US)

(72) Inventors: Manu Prakash, San Francisco, CA (US); Georgios Katsikis, Belmont, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 157 days.

(21) Appl. No.: 15/269,590

(22) Filed: Sep. 19, 2016

(65) Prior Publication Data

US 2017/0002846 A1 Jan. 5, 2017

Related U.S. Application Data

(63) Continuation-in-part of application No. 14/426,544, filed as application No. PCT/US2013/506821 on
(Continued)

(51) Int. Cl.
*F15C 3/00* (2006.01)
*B01L 3/00* (2006.01)
(Continued)

(52) U.S. Cl.
CPC .... *B01L 3/502792* (2013.01); *B01F 13/0077* (2013.01); *B01L 3/50273* (2013.01);
(Continued)

(58) Field of Classification Search
CPC ..... B01F 13/0077; B01L 2300/0816; B01L 2300/0819; B01L 2300/0864; B01L 2300/0867; B01L 2400/043; B01L 3/502792; B01L 3/50273; B01L 2300/06; B01L 2200/0673; F04B 19/006
See application file for complete search history.

(56) References Cited

U.S. PATENT DOCUMENTS

2002/0106314 A1* 8/2002 Pelrine ..... B01J 19/0046 422/186
2011/0059556 A1* 3/2011 Strey ..... B01L 3/502761 436/518

* cited by examiner

*Primary Examiner* — Jennifer Wecker
(74) *Attorney, Agent, or Firm* — Lumen Patent Firm

(57) ABSTRACT

A magnetic-hydrodynamic force fluid logic controller is provide that includes a solid or flexible or flexible substrate, a fluid chamber disposed above the substrate, where the chamber includes a fluid under test that includes an active magnet, where the active magnet is disposed to control a magnetic north pole of the droplet and a magnetic south pole of the droplet, a two-dimensional distribution of magnetic elements a surface the solid or flexible substrate, where the magnetic elements comprise a magnetization in a magnetic north pole and magnetization in a magnetic south pole, where the magnetic elements are activated by an external magnetic field of the active magnet, where the droplets have a droplet magnetization, where the droplet magnetization is configured for droplet self-interaction by the magnetic elements and the active magnet, where the self-interaction comprises splitting, merging, propagation, logic, storage, memory and all possible combinations of logical circuit operations.

19 Claims, 12 Drawing Sheets

Related U.S. Application Data

Aug. 27, 2013, and a continuation-in-part of application No. 15/157,261, filed on May 17, 2016.

(60) Provisional application No. 61/693,346, filed on Aug. 27, 2012, provisional application No. 62/164,323, filed on May 20, 2015.

(51) Int. Cl.

| | |
|---|---|
| ***F04B 19/00*** | (2006.01) |
| ***B01F 13/00*** | (2006.01) |
| *F15D 1/00* | (2006.01) |

(52) U.S. Cl.

CPC ..... *F04B 19/006* (2013.01); *B01L 2200/0673* (2013.01); *B01L 2300/06* (2013.01); *B01L 2300/0816* (2013.01); *B01L 2300/0819* (2013.01); *B01L 2300/0864* (2013.01); *B01L 2300/0867* (2013.01); *B01L 2400/043* (2013.01)

| Truth Table | | |
|---|---|---|
| C | A | $\overline{A}$ |
| 1 | 0 | 1 |
| 1 | 1 | 0 |

| Truth Table | | | |
|---|---|---|---|
| A | B | A•B | A+B |
| 1 | 0 | 1 | 0 |
| 1 | 1 | 1 | 1 |
| 0 | 0 | 0 | 0 |
| 0 | 1 | 1 | 0 |
FIG. 5A
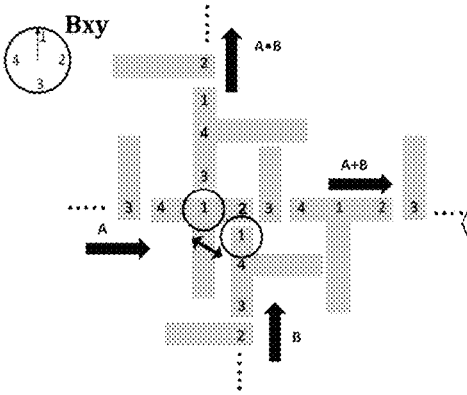
FIG. 5B
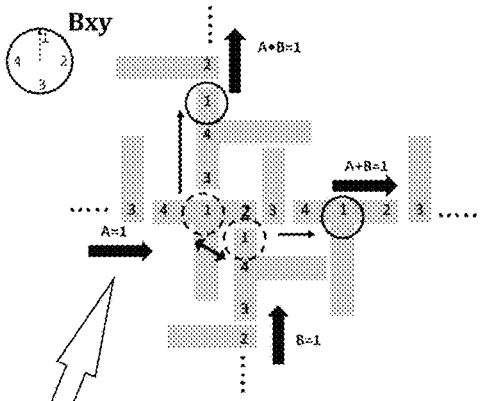
FIG. 5C
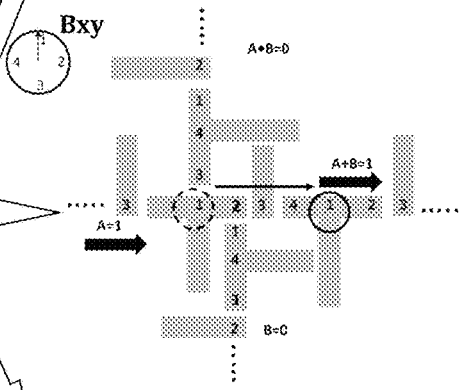
FIG. 5D
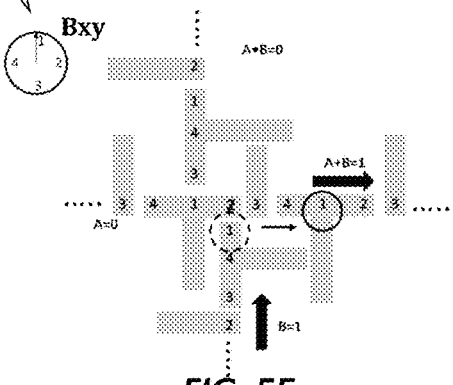
FIG. 5E

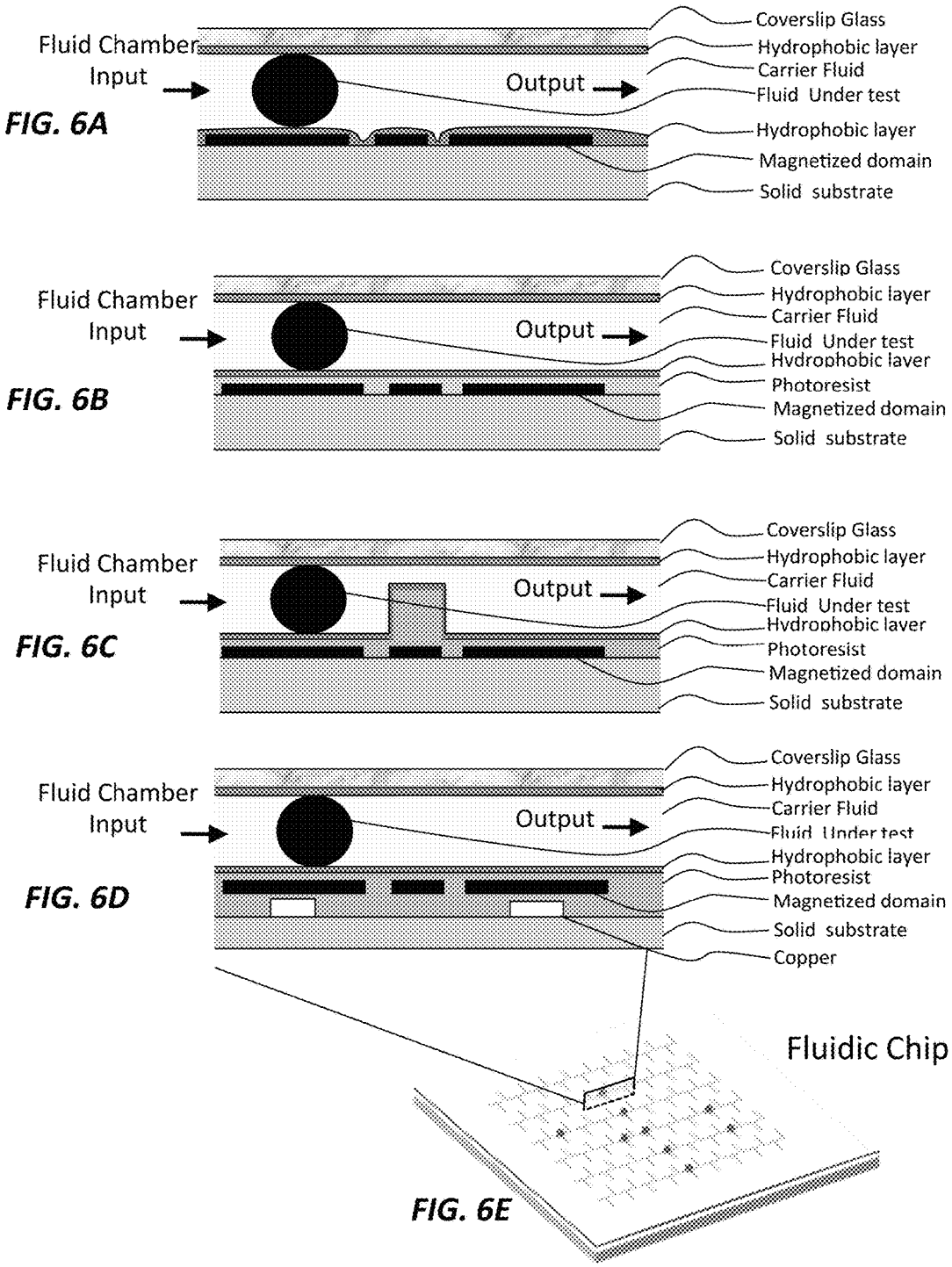
Fluid Chamber
Input
Output
Coverslip Glass
Hydrophobic layer
Carrier Fluid
Fluid Under test
Hydrophobic layer
Magnetized domain
Solid substrate
FIG. 6A
Fluid Chamber
Input
Output
Coverslip Glass
Hydrophobic layer
Carrier Fluid
Fluid Under test
Hydrophobic layer
Photoresist
Magnetized domain
Solid substrate
FIG. 6B
Fluid Chamber
Input
Output
Coverslip Glass
Hydrophobic layer
Carrier Fluid
Fluid Under test
Hydrophobic layer
Photoresist
Magnetized domain
Solid substrate
FIG. 6C
Fluid Chamber
Input
Output
Coverslip Glass
Hydrophobic layer
Carrier Fluid
Fluid Under test
Hydrophobic layer
Photoresist
Magnetized domain
Solid substrate
Copper
FIG. 6D
Fluidic Chip
FIG. 6E

*FIG. 8A*
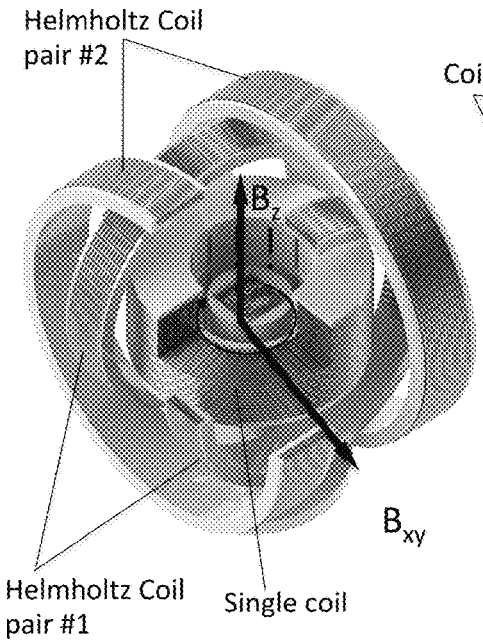
*FIG. 8B*
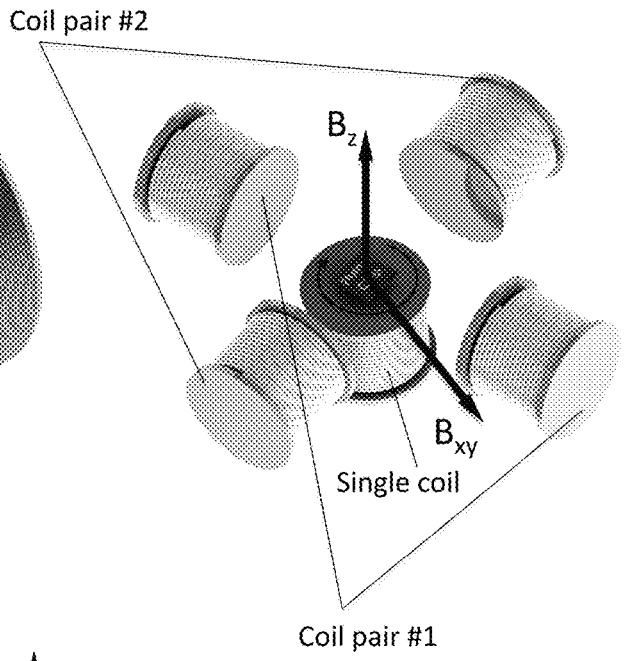
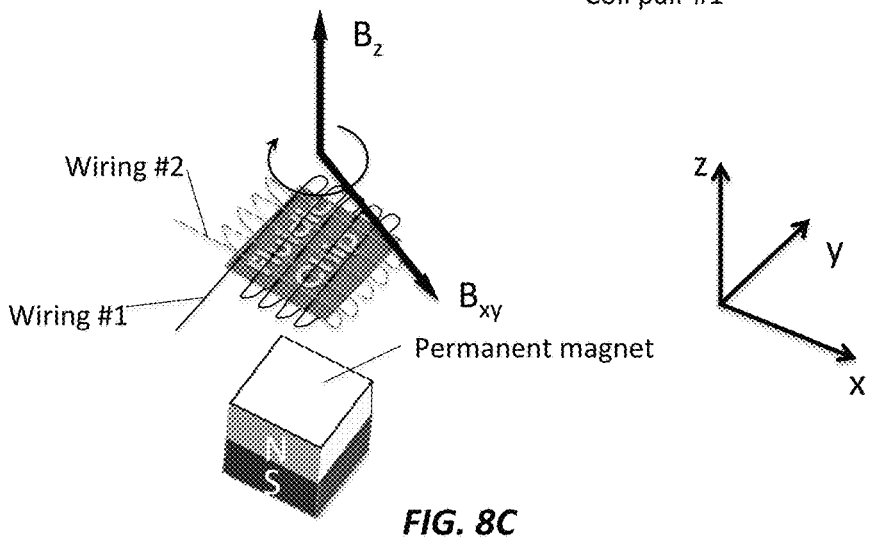
*FIG. 8C*

SYNCHRONOUS UNIVERSAL DROPLET LOGIC

CROSS-REFERENCE TO RELATED APPLICATIONS

This application is a continuation-in-part of U.S. patent application Ser. No. 14/426,544 filed Mar. 6, 2015, which is incorporated herein by reference. U.S. patent application Ser. No. 14/426,544 claims benefit of PCT Application PCT/US2013/506821 filed Aug. 27, 2013, which is incorporated herein by reference. PCT Application PCT/US2013/506821 claims benefit of U.S. Provisional Patent Application 62/164,323, filed May 20, 2015, which is incorporated herein by reference. This application is a continuation-in-part of U.S. patent application Ser. No. 15/157,261 filed May 17, 2016, which is incorporated herein by reference. U.S. patent application Ser. No. 15/157,261 claims benefit of U.S. Provisional Patent Application 62/164,323, filed May 20, 2015, which is incorporated herein by reference.

FIELD OF THE INVENTION

The current invention generally relates to Microfluidics. More specifically, the invention relates to Microfluidics devices for the manipulation of micro- to nano-liter fluidic volumes.

BACKGROUND OF THE INVENTION

Droplet based microfluidics is a rapidly growing interdisciplinary field of research with numerous applications ranging from fast analytical systems or synthesis of advanced materials to protein crystallization and biological assays for living cells. What is needed is a device and method for the precise and reliable control of multiple droplet volumes simultaneously with a control mechanism of minimal complexity that are configured to operate droplet self-interaction to form logic operations.

SUMMARY OF THE INVENTION

To address the needs in the art, a magnetic-hydrodynamic force fluid logic controller is provide that includes a solid or flexible substrate, a fluid chamber disposed above the substrate, where the chamber includes a fluid under test that includes an active magnet, where the active magnet is disposed to control a magnetic north pole of the droplet and a magnetic south pole of the droplet, a two-dimensional distribution of magnetic elements a surface the solid or flexible substrate, where the magnetic elements comprise a magnetization in a magnetic north pole and magnetization in a magnetic south pole, where the magnetic elements are activated by an external magnetic field of the active magnet, where the droplets have a droplet magnetization, where the droplet magnetization is configured for droplet self-interaction by the magnetic elements and the active magnet, where the self-interaction comprises splitting, merging, propagation, logic, storage, memory and logical circuit operations.

According to one aspect of the invention, the fluid under test includes a single-phase fluid under test, a carrier fluid, or the single-phase fluid under test and the carrier fluid, where the active magnet is disposed to control the fluid under test. In one aspect, the fluid test can include water-based ferrofluid, oil-based ferrofluid, fluid with magnetic beads, magnetic nanoparticles dispensed in a fluid, fluid with magnetic surfactant on the solid or flexible substrate surface, magnetic fluid, non-magnetic fluid, water, water coated with surfactants, silicon oil, fluoro-inert oil, or hydrocarbon oil. In another aspect, the carrier fluid is non-ferric and the fluid under test is ferric, or the carrier fluid is ferric and the fluid under test is non-ferric, or the carrier fluid is non-ferric and the fluid under test comprises a multi-phase emulsion of i) a ferric outside fluid and a non-ferric inside fluid, or ii) a ferric inside fluid and a non-ferric outside fluid.

In a further aspect of the current invention, the fluid under test includes droplets with volumes in a range from 1 nl to 100 μl.

According to another aspect of the invention, the two dimensional distribution of magnetized domains have shapes that include T-shape, I-shape, linear-shape, serpentine-5 shape, undulating width-shape, stepped-shape, zig-zag-shape, chevron-shape, of an arbitrary-shape. In one aspect, the two dimensional distribution of magnetized domains are configured to operate the self-interaction to form operations that include OR, AND, XOR, NAND, NOR, Full Adders, flip-flop memory elements, or cascaded logic elements.

In yet another aspect of the invention, the solid or flexible substrate surface includes a flat surface or a non-flat surface. In one aspect, the flat surface comprises a material selected from the group consisting of epoxy-based negative photoresist and silica.

According to one aspect of the invention, the solid or flexible substrate includes an electrically conductive material, where the electrically conductive material includes copper or gold.

In another aspect of the invention, the fluid chamber has surfaces that include hydrophobic, oleophobic, superhydrophobic, or superoleophobic surfaces. In one aspect, the surfaces have material that includes Teflon, PDMS, fluorosilanes, silicon-based spray-on coating, fluorinated acrylate oligomers, or monomers.

In a further aspect of the invention, the solid or flexible substrate is a material that includes silica, $SiO_2$, silicon wafer, plastic, metal or a non-magnetic solid or flexible material.

According to one aspect of the invention, the magnetized domain comprises permalloy bars, or a magnetic material ranging in size from a 100 nm to 100 mm.

In yet another aspect of the invention, the active magnet forms a dynamic magnetic field that includes a rotating magnetic field, a varying magnitude magnetic field, an x-direction oscillating magnetic field, a y-direction oscillating magnetic field, an ON-OFF magnetic field, clocked magnetic field, a periodically varying magnetic field profile, or an aperiodically varying magnetic field profile.

According to another aspect of the invention, the fluid chamber includes fluid guides, where the fluid guides include walls, channels, grooves, indentations, protrusions, or channels, where the fluid guides are disposed to provide hydrodynamic resistant inside the fluid chamber.

In another aspect of the invention, the fluid chamber includes a fluid input port and a fluid output port, where i) the fluid under test, ii) the carrier fluid, or iii) the fluid under test and the carrier fluid are input through the input port and output through the output port.

In a further aspect of the invention, the two-dimensional distribution of magnetized domains are disposed to i) collide a droplet of the fluid under test with another droplet of the fluid under test, or ii) to merge two droplets of the fluid under test, or iii) break a droplet of the fluid under test into at least two smaller droplets of the fluid under test, or iv) to dispense a known amount of the fluid under test, or v) to dilute the fluid under test, or vi) to concentrate the fluid under test, or vii) to start chemical reactions in the fluid under test, or viii) to stop a chemical reaction of the fluid under test.

In another aspect of the invention, a plurality of the substrates, the fluid chambers and the magnetic elements are disposed in a stacked array forming a three-dimensional manifold for the droplets.

BRIEF DESCRIPTION OF THE DRAWINGS

FIGS. 5A-5E show an AND-OR logic gate of the droplet controller, according to embodiments of the current invention.

FIGS. 6A-6E show different embodiments for the design of the solid or flexible substrate and fluid chamber of the droplet controller, according to the current invention.

FIGS. 8A-8C show different embodiments for the system of electromagnetic coils/permanent magnets of the droplet controller.

DETAILED DESCRIPTION

The current invention relates to a microfluidic device capable of propagating, merging or splitting microfluidic volumes of fluids using self-interactions between these volumes based on magnetic-hydrodynamic forces.

The current invention is based on the physical principle that a given fluid immersed in a carrier fluid (forming an immisciple solution between the two) is subject to self-repulsive forces on the double condition that 1) either the given fluid under test or the carrier fluid has magnetic properties and 2) there is an external magnetic field that magnetizes the magnetic component of the fluid solution. The self-repulsive force exerted on the fluid solution is of magnetic-hydrodynamic nature.

The current invention uses this self-repulsive magnetic-hydrodynamic force to cause microfluidic volumes of fluids (comprising of the fluid under test and the carrier fluid) to split, merge or propagate in different directions inside a fluid chamber. The fluid chamber is built on top of the solid or flexible substrate. The solid or flexible substrate has a two-dimensional distribution of magnetized domains that become activated by the magnetic fields generated by an active magnet. The active magnet also magnetizes the microfluidic volumes of fluids that obtain north and south poles. Therefore, the microfluidic volumes of fluids self-interact based on a magnetostatic force that tends to repel them from each other. Using different designs of the two-dimensional distribution of magnetized domains, the invention is disposed to control under the conditions: 1) if the self-interacting fluidic volumes are split in smaller volumes, 2) if self-interacting fluidic volumes are merged in bigger volumes, and 3) if the self-interacting fluidic volumes maintain a constant volume but they are diverted and propagate along a given path. Regarding the $3^{rd}$ case, diverting a fluid volume along a given path can be equivalent to a binary logic operation, where the result "1" is the presence of a fluidic volume at a given path and "0" is the absence of a fluidic volume at a path. One key aspect of the invention is the fluid under test comprises droplets of micro- to nano-liter volumes. The invention is termed herein as "a droplet logic controller".

Figure 1:
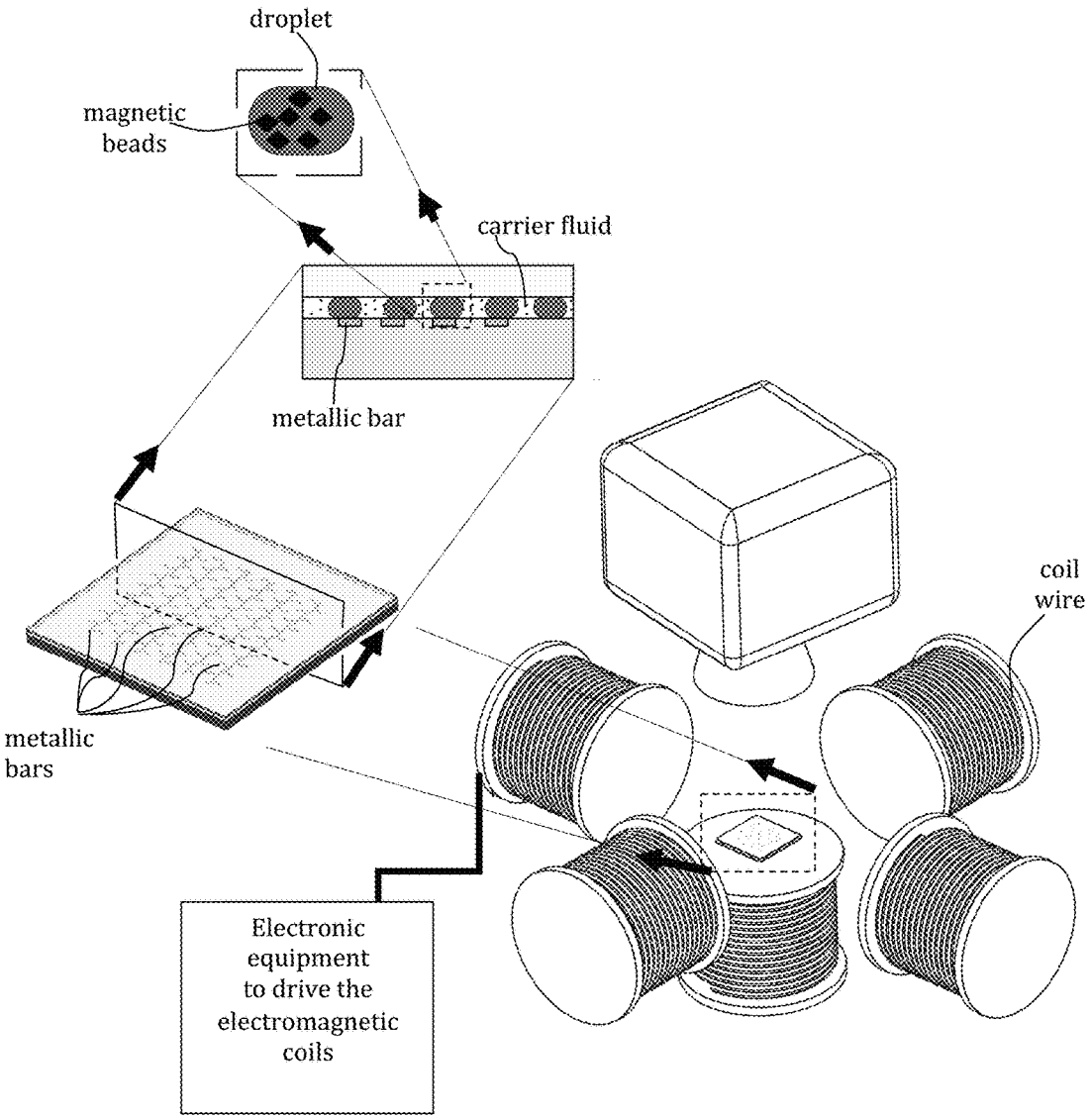
FIG. 1 shows a high-level description of the six components of the droplet controller using an isometric orientation and zoom views on individual components, according to the current invention.
Figure 2A:
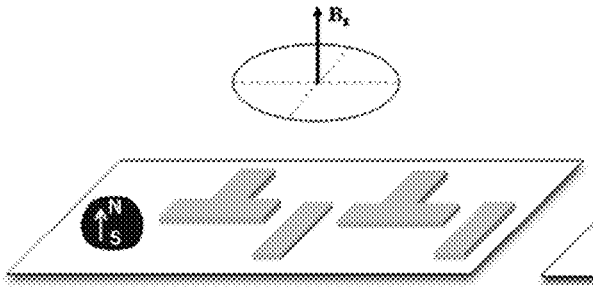
FIGS. 2A-2F show the principle of operation of the droplet controller: how a single droplet propagates on a track of metallic bars under the influence of two external magnetic fields, according to the current invention.
Figure 2B:
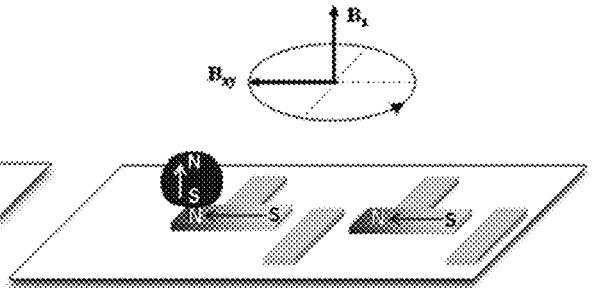
Figure 2C:
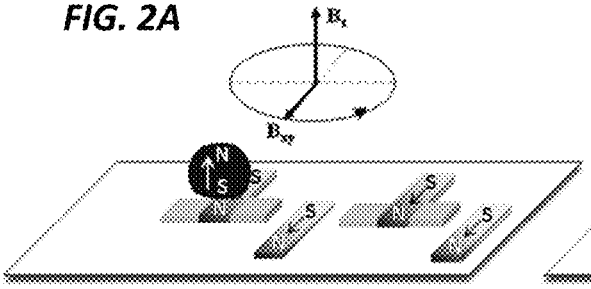
Figure 2D:
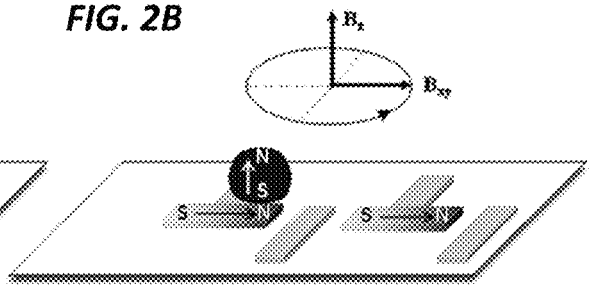
Figure 2E:
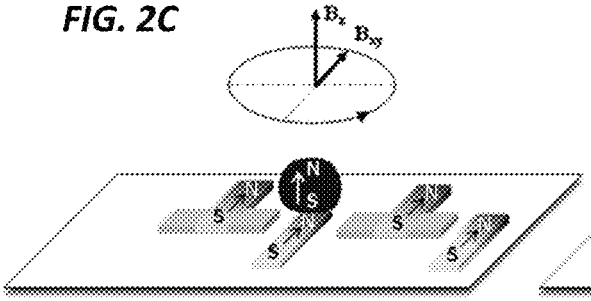
Figure 2F:
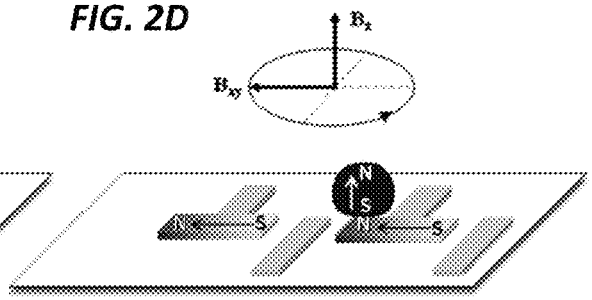

One embodiment of the droplet logic controller includes six components, as shown in FIG. 1, that include: 1) a solid or flexible substrate that bears the magnetic bars, 2) a fluid chamber that is mounted on top of the solid or flexible substrate and contains the droplets, 3) the fluidic solution that comprises a fluid under test with the magnetic beads and a carrier fluid that is inside the fluid chamber, 4) a system of electromagnetic coils and/or permanent magnets that provide the external magnetic fields which magnetize both the bars on the substrate and the magnetic beads within the droplets, 5) electronic equipment to drive the electromagnetic coils 6) a video camera and a microscope system that are used to monitor the droplets inside the fluid chamber.

In one embodiment, the substrate is made of non-magnetic material, such as glass, and bears soft magnetic thin rectangular bars on its surface. The flow chamber containing the droplets is mounted on top of the substrate such that the droplets capable of being manipulated by the fields generated by the substrate's thin rectangular bars. The principle of operation is provided in an exemplary embodiment shown in FIGS. 2A-2F for the substrate and the droplets. The bars are polarized using an in-plane rotating field $B_{xy}$, thus forming north and south poles. The droplets, shown as black ellipsoids in FIGS. 2A-2F, are made of ferrofluid (water-based solution of 10 nm magnetic beads hold together by surfactants) and are polarized out-of-plane by a static normal magnetic field $B_z$. Each droplet is set in motion to match its south pole to the north pole of the bar. For the shape of the bars, a periodic track of "T-bars" and "I-bars" are used in this example. When placed in a rotating field $B_{xy}$, the "T & I-bar" arrangement will produce a cascade, from left to right, of four north poles per full rotation of $B_{xy}$, creating a propagation pathway for the droplet.

Note that by using only those two magnetic fields $B_{xy}$, $B_z$ and a continuous track of "T-bars" and "I-bars" populated with droplets, all these droplets can be set in motion without the need to control each of them individually. In addition, all the droplets move in synchronous fashion since they follow the north poles on the bars that are created by the rotating magnetic field $B_{xy}$.

The "T & I-bar" arrangement represents only one embodiment of the device, where the shape of the bars does not need to have necessarily the "T" and "I" letter shape. A wide range of shapes can produce distinct north and poles, creating propagation pathways for the droplets. In FIGS.

3A-3Q various shapes for the designs of the bars are shown: 3A) T shape 3B) double T shape 3C) I shape 3D) S shape 3E) serpentine shape 3F) zig-zag shape 3G) chevron shape 3H) curved shape 3I) unequal chevron shape with protrusion 3J) crossed I bars 3K) I shape with protrusions 3L) circular shape 3M) unequal double T shape 3N) unequal double T shape with protrusions 3O) T shape with protrusions 3P) slanted T shape 3Q) double slanted T shape. In one aspect, the two dimensional distribution of magnetized domains are configured to operate the self-interaction to form operations that include OR, AND, XOR, NAND, NOR, Full Adders, flip-flop memory elements, or cascaded logic elements. An important aspect here is that all the key basic logic gates are within the scope of the invention, where this logic family is "universal". According to the current invention, any circuit that can be made in digital logic is possible by this invention, and thus the system is "scalable".

The solid or flexible substrate can be made of a non-magnetic material that is silica, $SiO_2$, silicon wafer, plastic or non-magnetic metal, according to different embodiments. The metallic bars can be made of permalloy material or any soft-magnetic material, according to further embodiments. Note that the material of the bars needs to be magnetic and preferably soft magnetic (exhibiting negligible hysteresis and coercivity) so that it can respond instantaneously to the rotating field $B_{xy}$ without any delay in the formation of magnetic poles. According to one aspect of the invention, the magnetized domain comprises permalloy bars, or a magnetic material ranging in size from a 100 nm to 100 mm.

Figures 3A, 3B, 3C, 3D, 3E, 3F:
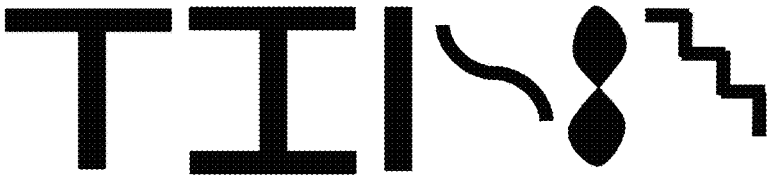
FIGS. 3A-3Q show different embodiments for designs of metallic bars, according to embodiments of the current invention.
Figures 3G, 3H, 3I, 3J, 3K, 3L:
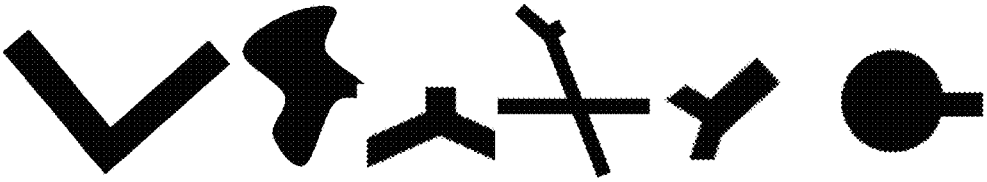
Figures 3M, 3N, 3O, 3P, 3Q:
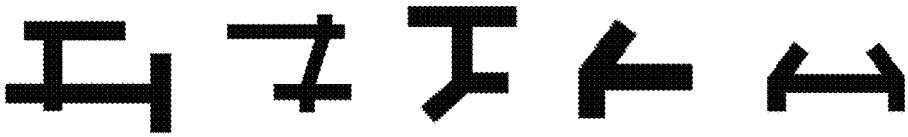

Apart from the propagation mechanism, the combination of bars enables the building of physical logic gates utilizing interactions between two or more droplets. Described herein is an exemplary building of three physical logic gates 1) AND, 2) OR, 3) NOT. These types of logic gates are very important because—through their combination—any logic gate (universal logic) can be created. Contrary to logic gates of electronic circuits, the physical logic gates described herein are conservative because no droplets can be generated or destroyed. The interactions are based on a magnetic repulsive force between two adjacent droplets that have parallel magnetizations (magnetized by the external field Bz). These logic gates can be created using intersecting "T" and "I" bar tracks (though other shapes of bars, for example like those shown in FIG. 3, can be similarly used), where two droplets attempt to occupy the same north pole on a bar on a droplet junction. Because of the repulsive force, one or both of them can be diverted to different pathways.

Figures 4A, 4B:
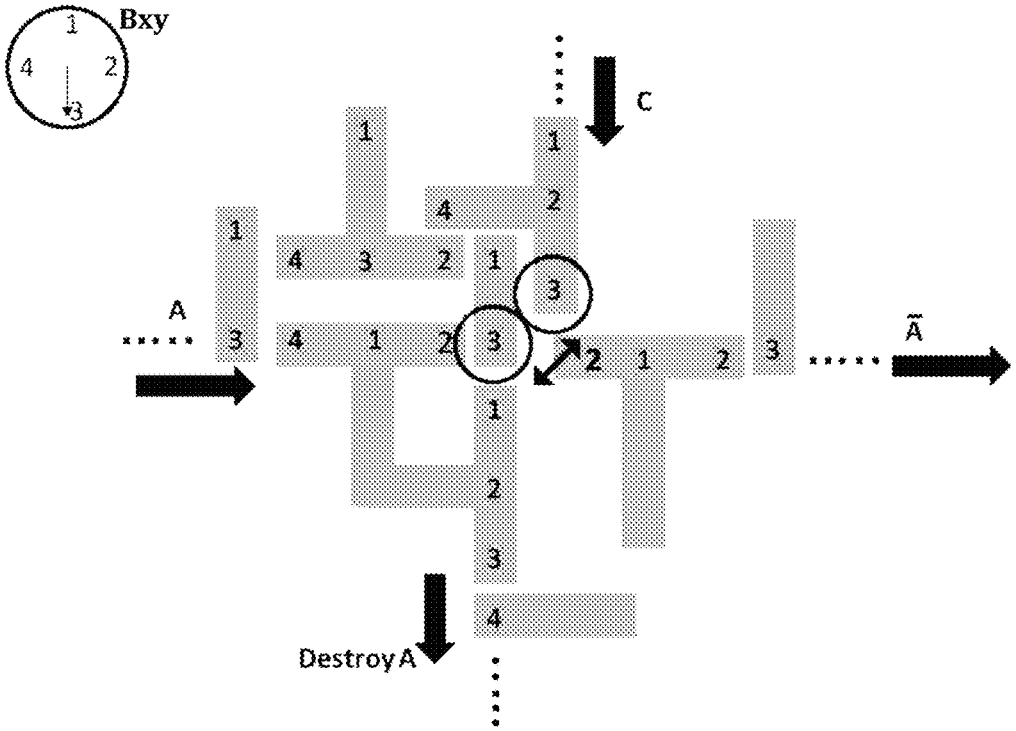
FIGS. 4A-4D show a NOT logic gate of the droplet controller, according to embodiments of the current invention.
Figure 4C:
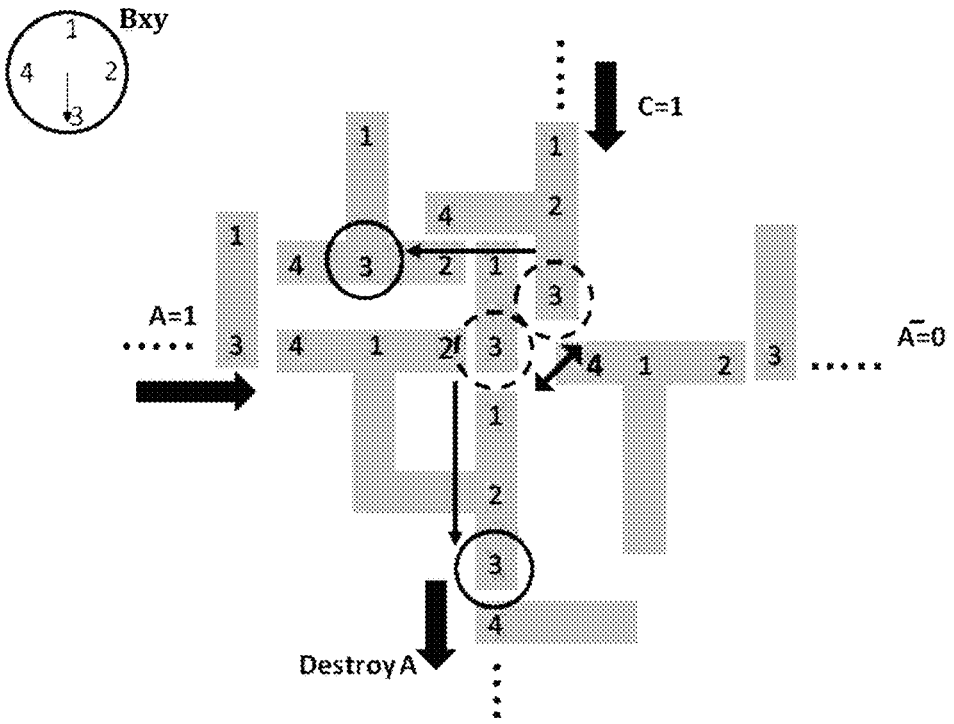
Figure 4D:
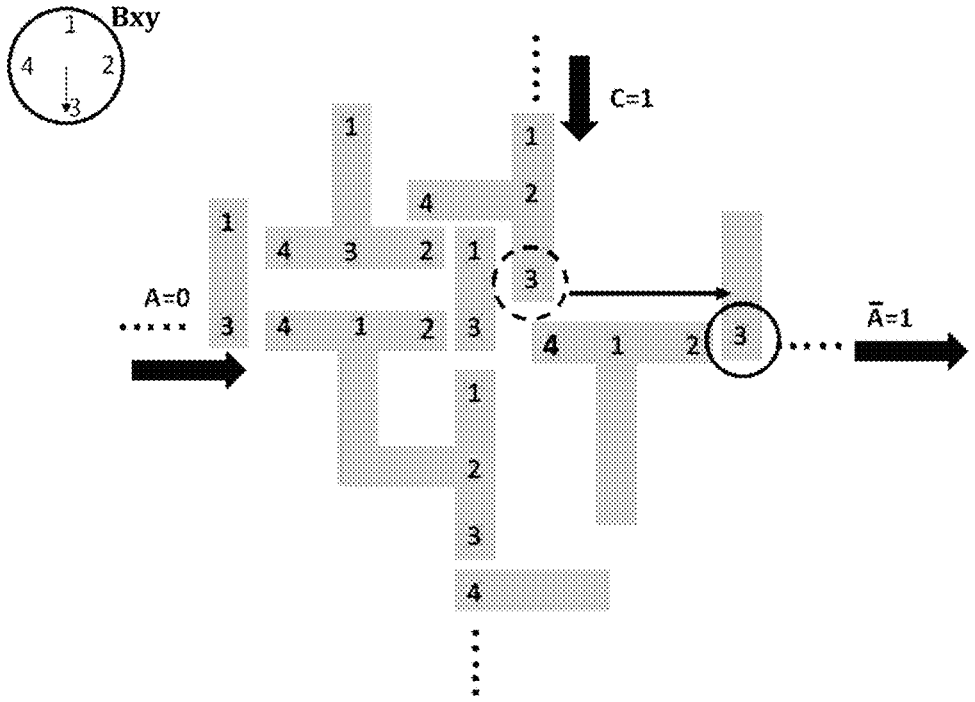

FIGS. 4A-4D shows a top view of a droplet junction that performs a NOT logic operation. The field $B_{xy}$ is rotating clockwise in the sequence 1-2-3-4 obtaining the angular orientations shown in the white circles on the top left corner of each one of FIGS. 4B-4D. For every position 1-4 of $B_{xy}$, north poles are created on the bars (marked as 1-4). The droplets (shown as transparent circles) move following the sequence 1-2-3-4. FIG. 4A shows the truth table for the NOT gate and FIG. 4B shows a general schematic of the gate. The NOT gate is a junction with an input A, an logic NOT output $\overline{A}$ and a control droplet C. Droplets at positions 3 before the junction will repel each other (repulsion force indicated by line with two arrow ends). In FIG. 4C we show the case $\overline{A}$=1, where the droplet is prevented from propagating rightwards (A=0). Dashed and Solid droplet lines indicate past and present droplet positions. FIG. 4D we shows the case A=0 where the droplet C, creates an $\overline{A}$=1 rightwards.

FIGS. 5A-5E show a top view of a droplet junction that performs a double AND/OR logic operation. The field $B_{xy}$ is rotating clockwise in the sequence 1-2-3-4 in the angular orientations shown in the white circles on the top left corner of each one of FIGS. 5B-5D (similar notation as in the FIGS. 4B-4D). For every position 1-4 of $B_{xy}$, north poles are created on the bars (marked as 1-4). The droplets (shown as transparent circles) move following the sequences 1-2-3-4. FIG. 5A shows the truth table for the AND/OR gate and FIG. 5B shows a general schematic of the AND/OR gate. The AND/OR gate is a junction with two inputs A, B and two outputs, where one output is the logic AND (A·B) and the second output is the logic OR (A+B). Droplets at positions 1 will repel each other (repulsion force indicated by line with two arrow ends). As in FIGS. 4A-4D, dashed and solid droplet lines indicate past and present droplet positions. FIG. 5C shows the case A=1, B=1 where the both outputs are equal to 1. FIG. 5D shows the case A=1, B=0. while in FIG. 5E shows the case A=0, B=1. According to aspects of the current invention, the two-dimensional distribution of magnetized domains are disposed to i) collide a droplet of the fluid under test with another droplet of the fluid under test, or ii) to merge two droplets of the fluid under test, or iii) break a droplet of the fluid under test into at least two smaller droplets of the fluid under test, or iv) to dispense a known amount of the fluid under test, or v) to dilute the fluid under test, or vi) to concentrate the fluid under test, or vii) to start chemical reactions in the fluid under test, or viii) to stop a chemical reaction of the fluid under test.

In a further embodiment, a fluid chamber is mounted on top of the substrate. According to the invention, the fluid chamber includes a fluid input port and a fluid output port, where i) the fluid under test, ii) the carrier fluid, or iii) the fluid under test and the carrier fluid are input through the input port and output through the output port. Here, presented are different low-level embodiments for the assembly between the fluid chamber and the solid or flexible substrate based on standard microfabrication methods (photolithography) used in microfluidics. FIGS. 6A-6E show cross-section views of four different embodiments (FIGS. 6A-6D) obtained from the high-level assembly of the fluid chamber and the solid or flexible substrate (FIG. 6E). All four embodiments of FIGS. 6A-6D include a solid or flexible substrate, fluid input and output port, arrays of metallic bars disposed on a surface of the solid or flexible substrate and a fluid chamber mounted on top that includes a top cover. The top cover isolates the droplets and prevents unwanted evaporation of the fluids. The top cover can be made of glass, acrylic or Polydimethylsiloxane (PDMS), a widely used silicon-based organic polymer used extensively in microfluidics. In essence, any non-magnetic material, could be used for the top cover as long it is inert, non-toxic, and non-flammable. Preferably the top cover should be optically clear to allow monitoring of the droplets by a video camera (see FIG. 1). All of the embodiments have a non-wetting layer deposited in the surfaces that come in contact with the droplet, i.e. the bottom side of the top cover and the top side of the solid or flexible substrate. The non-wetting layer allows the smooth movement of the droplet in the fluid chamber avoiding pinning effects, where the droplet could unexpectedly get stuck on the surface. The composition of the non-wetting surface depends on the type of the droplet. For example, if the droplets are water-based, the non-wetting layers need to be hydrophobic like Teflon, fluorosilanes, PDMS, silicon based spray and other types of superhydrophobic materials that have been used successfully in the field of microfluidics. If the droplets are oil-based, oleophobic layers are needed, e.g. fluoropolymer-based solids. In summary of this aspect of the invention, the fluid chamber has surfaces that include hydrophobic, oleophobic, superhydrophobic, or superoleophobic surfaces, where the surfaces can have material that includes Teflon, PDMS, fluorosilanes, silicon-based spray-on coating, fluorinated acrylate oligomers, or monomers.

According to one aspect of the invention, the fluid under test includes a single-phase fluid under test, a carrier fluid, or the single-phase fluid under test and the carrier fluid, where the active magnet is disposed to control the fluid under test. In one aspect, the fluid test can include water-based ferrofluid, oil-based ferrofluid, fluid with magnetic beads, magnetic nanoparticles dispensed in a fluid, fluid with magnetic surfactant on the solid or flexible substrate surface, magnetic fluid, non-magnetic fluid, water, water coated with surfactants, silicon oil, fluoro-inert oil, or hydrocarbon oil. In another aspect, the carrier fluid is non-ferric and the fluid under test is ferric, or the carrier fluid is ferric and the fluid under test is non-ferric, or the carrier fluid is non-ferric and the fluid under test comprises a multi-phase emulsion of i) a ferric outside fluid and a non-ferric inside fluid, or ii) a ferric inside fluid and a non-ferric outside fluid.

FIG. 6A shows an embodiment where the metallic bars are coated with a non-wetting layer. The droplet (the term "test fluid" is used herein to account for the different embodiments for the fluidic solution presented herein) thus flows in a closed top channel immersed in a carrier liquid. The embodiment shown in FIG. 6B is an extension to FIG. 6A where added is an additional flattening step: a filling material is deposited in excess on top of the metallic bars (like $SiO_2$, polymers, photoresists like Su-8) and then flattened to provide for a flat flow channel for the fluid under test. The embodiment shown in FIG. 6C is similar to the one shown in FIG. 6B but includes additional geometric structures in the providing hydrodynamic resistance/restrictions on the fluid chamber. A wide variety of geometric blocks can be applied like such as walls, channels, grooves, indentations, protrusions, and channels. FIG. 6D shows another embodiment where an inner layer of electrically conductive material lines like copper, gold or graphite can be added below the metallic bars domains. Applying a voltage difference across these lines results in a electric current which generates local magnetic fields. These local magnetic fields create local perturbations on the effective magnetic fields on the fluid channel that can enhance or diminish the effect of the polarized magnetic bars. The role of these conductive wires is to provide additional external control by the user.

The fluidic solution includes 1) a fluid under test, that has been assumed to be a water or oil-based droplet containing magnetic beads and 2) a carrier fluid. While the device can potentially work without the carrier fluid, the addition of the latter is important as it creates a lubrication film that reduces the drag resistance force exerted on the droplet as it flows in the fluid chamber. The carrier fluid also prevents other unwanted phenomena such as the drying of the droplet. To prevent the droplet from dissolving into the carrier liquid, they must be immiscible: if the droplet is water-based, the carrier fluid must be oil-based and vice versa.

Figure 7A:
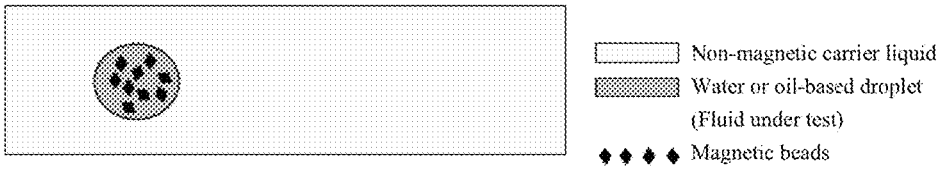
FIGS. 7A-7D show different embodiments for the fluid solution of the droplet controller, according to the current invention.
Figure 7B:
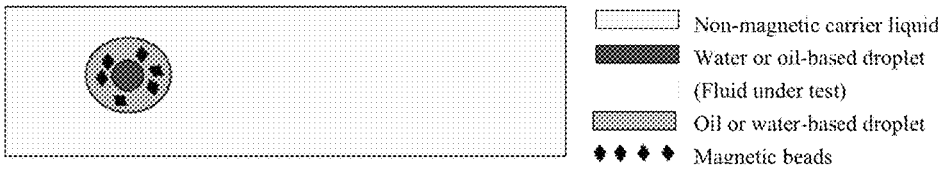
Figure 7C:
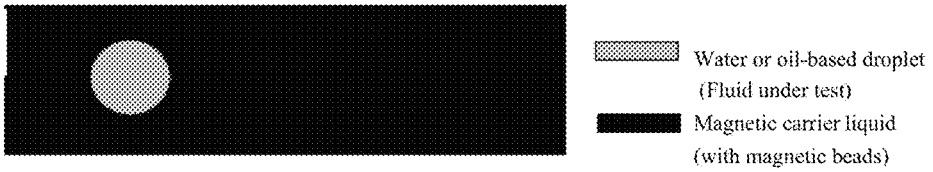
Figure 7D:
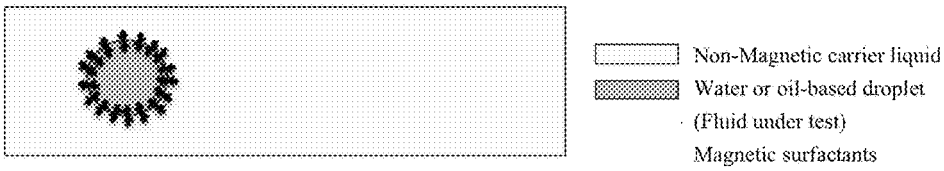

The fluidic solution includes different embodiments, for example the embodiments shown in FIGS. 7A-7D. Despite the fact that both the principle of operation in FIG. 2 and the logic gates in FIGS. 4A-5E were described using a droplet as a fluid under test, other embodiments can also work as long as there is at least one element in the fluidic solution with magnetic properties. FIG. 7A shows an exemplary embodiment, which is includes water or oil-based droplet carrying magnetic beads immersed in a immiscible carrier fluid. In the embodiment of FIG. 7B there is a stable emulsion of a droplet inside another droplet. The outer droplet contains the magnetic particles and thus is subject to the magnetic forces exerted by the magnetic bars of the solid or flexible substrate. The inner droplet is the fluid under test that may contain other particles of interest for potential applications. The two droplets can be kept distinct one from another by using surfactants at their interface enabling both of them to move together without mixing. The embodiment of a double droplet in FIG. 7B is based on the removal of the magnetic beads from the fluid under test, thus enabling it to carry any additional components that could not co-exist with the magnetic beads (incompatible or reactive). In FIG. 7C the fluidic solution is the inverse of the one in FIG. 7A: the droplet (fluid under test) is non-magnetic and the carrier fluid is magnetic containing the magnetic beads. Displacing the magnetic carrier fluid using the metallic bars of the solid or flexible substrate can cause the displacement of the non-magnetic droplet. Similar to the embodiment shown in FIG. 7B, the fluid under test is not magnetic and can therefore carry any components that could be incompatible with magnetic beads or perform processes (such as chemical reactions) that could not be achieved in the close vicinity of magnetic elements. In FIG. 7D, both the droplet (as the fluid under test) and the carrier fluid are non-magnetic but their interface is populated by magnetic surfactants that can make the droplet propagate.

The system of electromagnetic coils or permanent magnets generates the external magnetic fields that magnetize the metallic bars on the substrate and the droplet (magnetic fields $B_{xy}$, $B_z$ correspondingly in FIG. 2). The magnetic field $B_{xy}$ is exerted on the plane of the solid or flexible substrate and it is rotating with constant magnitude. The magnetic field $B_z$ is exerted perpendicular to the plane of the solid or flexible substrate, it has fixed a direction and a constant magnitude.

FIGS. 8A-8C show different embodiments for the system of coils/magnets. The embodiment in FIG. 8A includes two orthogonal Helmholtz coil pairs for the generation of the rotational field $B_{xy}$. The coil pairs are stationary and have winded copper wire with insulation coating. The fluidic chip (solid or flexible substrate and flow chamber) is placed at the geometric center of those two coil pairs. To generate a rotational field at the center of the coils where the fluidic chip is, each coil pair has an alternating current (AC) with 90° phase difference one from another. Therefore in FIG. 8A, the first coil pair generates a magnetic field $B_x$ along its symmetry axis (x) with a sinusoidal magnitude. The second coil pair generates a magnetic field $B_y$ along its symmetry axis (y) with a sinusoidal magnitude (we will generalize the term "sinusoidal" later) that has 90° phase difference in comparison to the first coil pair. The vector summation of those two orthogonal vectors, $B_x$, $B_y$ produces a rotational field $B_{xy}$ on the plane xy that has a frequency equal to the frequency of the AC current that flows in the wire. According to the embodiments in FIGS. 8A-8C, the coil pairs are Helmholtz-type (mean radius of coil is equal to the distance between the two coils compiling the pair) because this particular type provides optimal magnetic field uniformity in the center of the coil arrangement where the fluidic chip is placed. To generate a perpendicular field $B_z$ at the fluidic chip, the chip is placed in the center of an additional single coil. This single coil has a direct current (DC) that generates the field $B_z$ perpendicular to the fluidic chip, as shown in FIG. 8A. The use of a single coil allows 1) the easy ON/OFF activation of the field $B_z$ and 2) changing the magnitude of $B_z$ for experimentation purposes. However, the single coil with the DC current can also be substituted by a square or circular type of permanent magnet that will provide a constant $B_z$ field, even though this is not shown in FIG. 8A. In this case, the fluidic chip would have to be placed on top of the north or south pole of such a magnet.

FIG. 8B shows an embodiment similar to the one shown in FIG. 8A. The difference in FIG. 8B is that the coils are not Helmholtz-type. If the working area on the fluidic chip (the area where droplets propagate) is much smaller in comparison to the radii of the coils, then the uniformity of magnetic fields of this arrangement may be sufficient without the need for Helmholtz-type coil pairs. FIG. 8C shows an embodiment where the whole coil system can be shrunk in the form of a small chip. In this embodiment, instead of using coil pairs similar to FIGS. 8A-8B (much larger that the fluidic chip), two wirings are wound around the fluidic chips. The wirings are orthogonal to each other and have AC currents with 90° phase difference, in order to generate a rotating field $B_{xy}$ similar to the one in FIGS. 8A-8B. The perpendicular field $B_z$ is provided by a permanent magnet that is placed below the fluidic chip as shown in FIG. 8C.

Electronics can be used to drive the electromagnetic coils. In either of the three embodiments in FIGS. 8A-8C, the AC current that needs to flow into each of the two coil pairs with a 90° phase difference (in order to generate the rotating field $B_{xy}$), requires electronic equipment that should include: 1) a double-output waveform generator to generate two AC current signals with 90° phase difference and 2) a double-input/double output power amplifier that will receive the two AC signals from the waveform generator, amplify them and output them to the coils. The power amplifier can be either an audio amplifier (simplest solution) or a more sophisticated laboratory-setting AC power amplifier. The DC current needed to power the single coil (in order to generate the perpendicular field $B_z$) can be provided by a DC power supply. Additional DC signals needed to power the electrically conductive wires of the solid or flexible substrate shown in FIG. 6D can be provided by a microcontroller. The output pins of the microcontroller can be wired to the conductive wires of the solid or flexible substrate using standard wiring connection techniques.

As far as the rotating field $B_{xy}$ field is concerned, it can assume any type of rotation. If for example the $B_x$, $B_y$ fields are sinusoidal with the same frequency and 90° phase difference, their vector sum $B_{xy}$ will be a rotating field with the same frequency. In this first case, the orientation angle of $B_{xy}$ in the plane xy will change linearly. Another embodiment includes $B_x$, $B_y$ fields that have the same frequency and a phase difference of 90° but they are step waves. In this second case, the resulting $B_{xy}$ will be a rotating field with a rotation angle that will obtain only four discrete values at 0°, 90°, 180°, 270° with each of them lasting for one quarter of the period. Potentially, other combinations of the rotating $B_{xy}$ can work as long as $B_{xy}$ remains periodic.

In one embodiment, the device includes a video camera that is mounted above the fluidic chip to monitor the operation of the system. A microscope system will be coupled to the camera to provide that appropriate magnification objective lens. The microscope system may include light source, filters, beamsplitters, mirrors and other optical components known from prior art.

Additional features of the invention are provided herein. More specifically, the capacity to merge droplets or separate (break-up) a single droplet into two smaller droplets is provided. This capacity is very useful for a lot of applications as it can mix different components together (supposing that two droplets carrying different components merge into a single droplet) or distribute the content of a single droplet in two different directions (through the break-up of a single droplet).

Figure 9A:
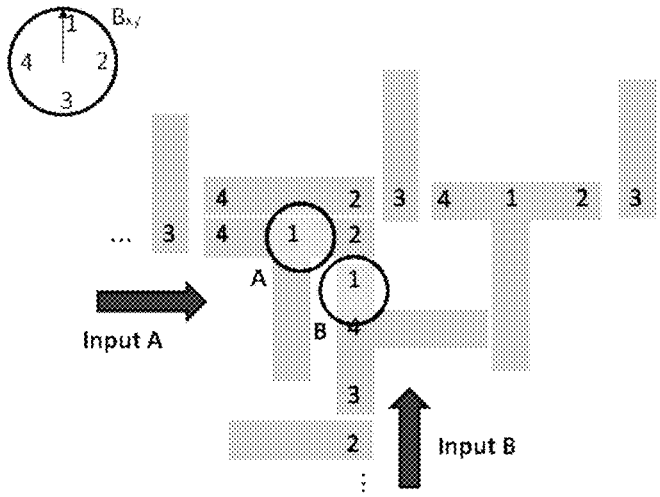
FIGS. 9A-9C show an arrangement of bars to merge two droplets into a single droplet, according to embodiments of the current invention.
Figure 9B:
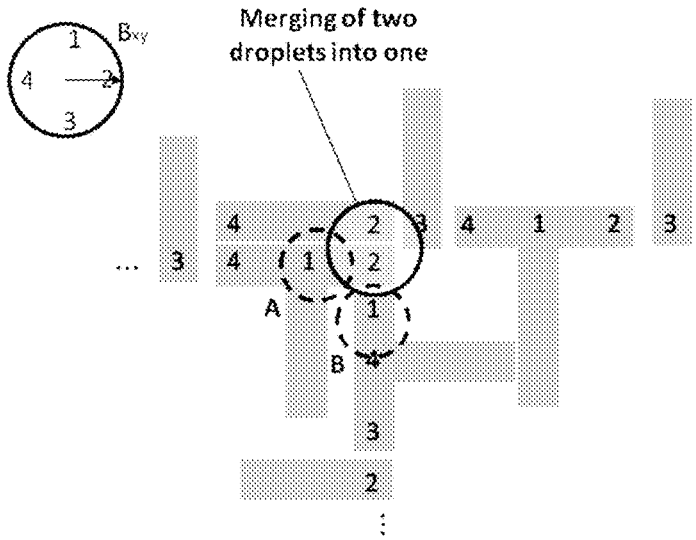
Figure 9C:
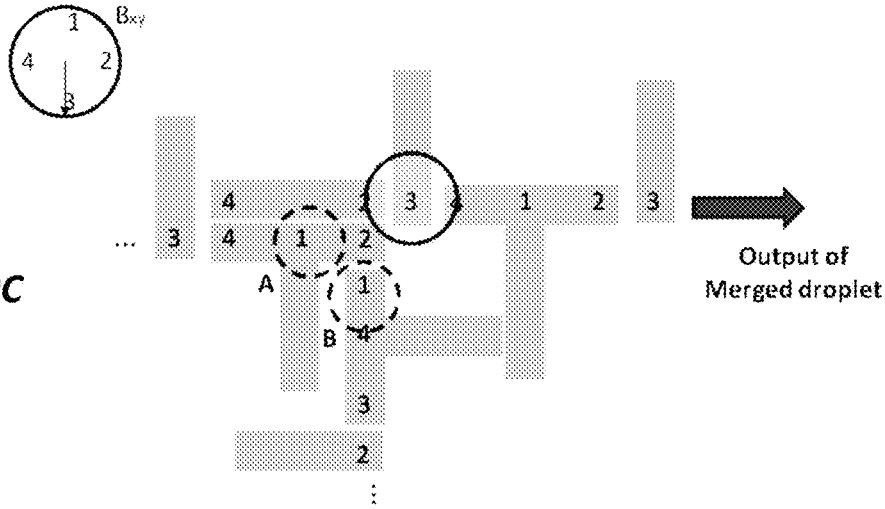

FIGS. 9A-9C show arrangements of "T" and "I" bars that merge two droplets into a single one. The two droplets, named A and B in FIG. 9A are occupying two different bars that have the orientation "1". Once the magnetic field $B_{xy}$ rotates to the position "2" as shown in FIG. 9B, both droplets A, B are drawn on the same double "I" letter bar with orientation "2". Stacking two "I" letter bars together, amplifies the attractive force exerted by the bars to the droplets, overcoming the droplet-to-droplet magnetostatic repulsion force. Once the droplets merge, the resulting single droplet can move to the position "3", as shown in FIG. 9C and keep propagating rightwards as a single output.

Figure 10A:
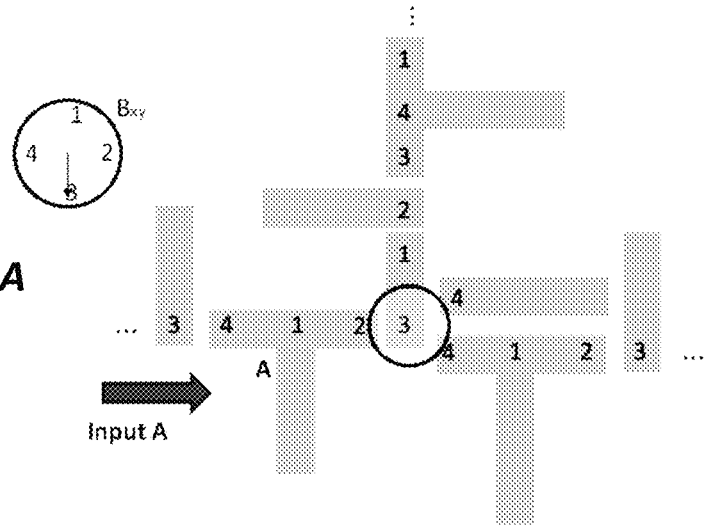
FIGS. 10A-10C show an arrangement of bars to break-up a single droplet into two droplets, according to embodiments of the current invention.
Figure 10B:
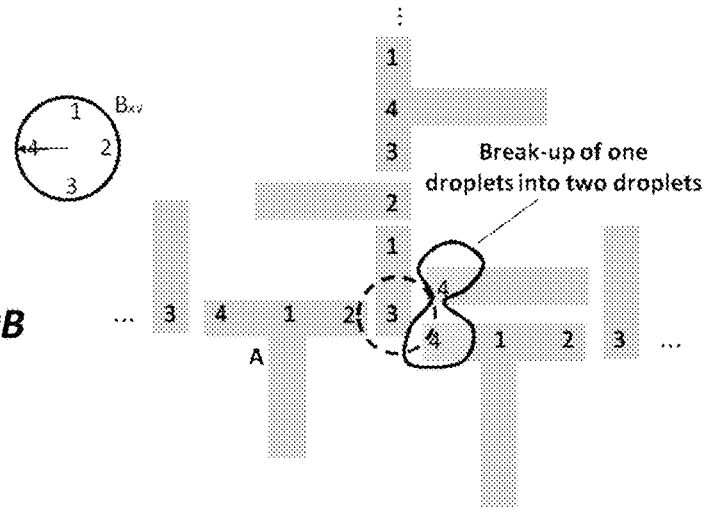
Figure 10C:
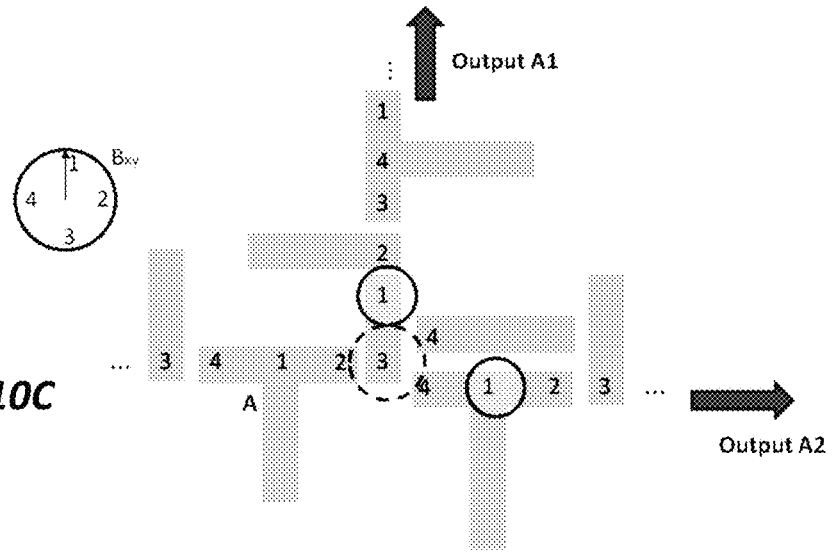

Similarly, FIGS. 10A-10C show arrangements of "T" and "I" bars that causes a single droplet A to break up into two droplets A1, A2. In FIG. 10A the single droplet is occupying a bar that has the orientation "3". Once the magnetic field rotates to the position 4 as shown in FIG. 10B, the single droplet is simultaneously attracted to two different parallel "I" bars that cause the droplet to stretch and start breaking-up. When the magnetic field $B_{xy}$ rotates to the position 1, as shown in FIG. 10C, the droplet breakes-up into two droplets A1, A2 that occupy different bars with orientations "1". After breaking-up, the droplets A1, A2 propagate in different directions.

Similar merging or break-up mechanisms can be made using different arrangements and/or different shapes for the bars.

In the current invention, either the fluid under test or the carrier liquid can include: water-based ferrofluid, oil-based ferrofluid, fluid with magnetic beads, magnetic nanoparticles dispensed in a fluid, and fluid with magnetic surfactant on the surface silicone oil, hydrocarbon oil, fluoroinert oil, water, all optionally coated with surfactants. Aspects of the invention include all multiple combinations between the test and the carrier fluid where i) the carrier fluid is non-magnetic and the fluid under test is magnetic, or ii) the carrier fluid magnetic and the fluid under test is non-magnetic, or iii) the carrier fluid non-magnetic and the fluid under test is a multi-phase emulsion of magnetic fluid.

Figure 11:
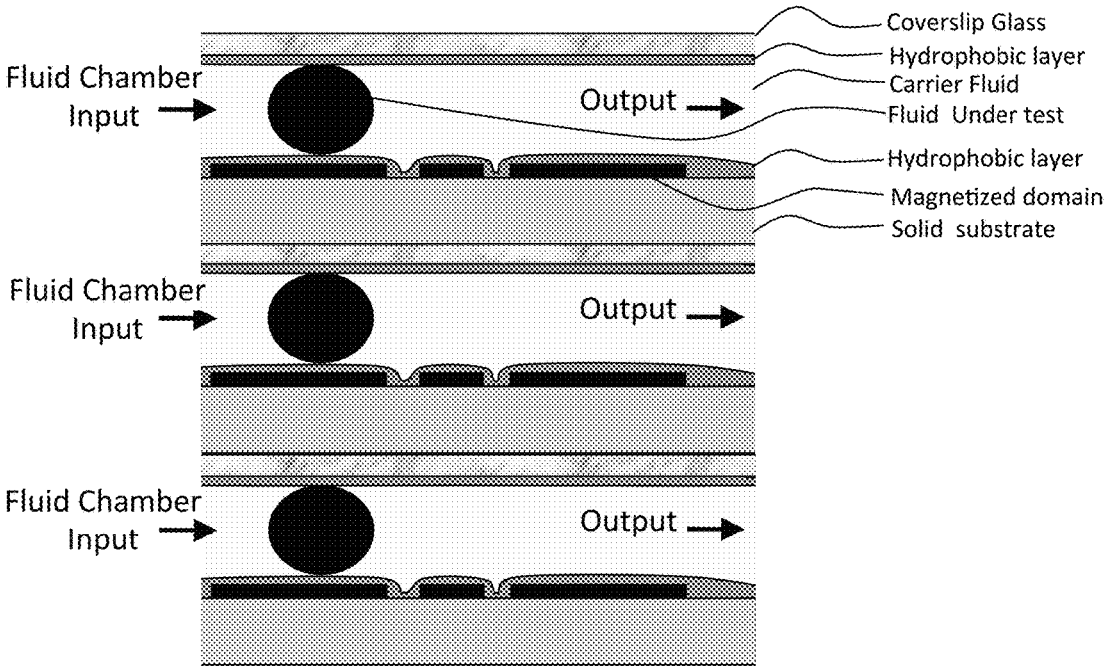
FIG. 11 shows a stacked array forming a three dimensional manifold for the droplets, according to one embodiment of the invention.

FIG. 11 shows a plurality of the substrates, the fluid chambers and the magnetic elements are disposed in a stacked array forming a three dimensional manifold for the droplets. In yet another aspect of the invention, the solid or flexible substrate surface includes a flat surface or a non-flat surface. In one aspect, the flat surface comprises a material selected from the group consisting of epoxy-based negative photoresist and silica.

In one aspect of the invention, the fluid under test includes droplets of micro- to nano-liter volumes. In a further aspect of the current invention, the fluid under test includes droplets with volumes in a range from 1 nl to 100 μl.

According to another aspect of the invention, the magnetized domain includes permalloy bars, or soft magnetic material.

In another aspect of the invention, the active magnet can generate a dynamic magnetic field can be a rotating magnetic field, a varying magnitude magnetic field, an x-direction oscillating magnetic field, a y-direction oscillating magnetic field, an ON-OFF magnetic field in the z-direction, a clocked magnetic field, or a periodically varying magnetic field profile. In a further aspect of the invention, the active magnet is disposed external to the solid or flexible substrate or the active magnet is embedded on the solid or flexible substrate.

In another aspect, the invention further includes a micro-coil or current wire disposed above the fluid chamber and disposed to apply an external magnetic field external to the droplet controller.

In a further aspect of the invention, the magnetized domain includes permalloy bars, or a magnetic material ranging in size from a 100 nm to 100 mm.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. All such variations are considered to be within the scope and spirit of the present invention as defined by the following claims and their legal equivalents.

What is claimed:

1. A magnetic-hydrodynamic force fluid logic controller, comprising:

a) a solid or flexible substrate;

b) a fluid chamber disposed above said substrate, wherein said chamber comprises a fluid under test, wherein said fluid under test comprises droplets;

c) an active magnet, wherein said active magnet is disposed configured to control a magnetic north pole of said droplet and a magnetic south pole of said droplet; and d) a two-dimensional distribution of magnetic elements or a three-dimensional distribution of said magnetic elements on a surface of said solid or flexible substrate or a layer of 2D surfaces assembled in a 3D volume, wherein said magnetic elements comprise a magnetization in a magnetic north pole and a magnetization in a magnetic south pole, wherein said magnetic elements are configured to be activated by an external magnetic field of said active magnet, wherein said droplets comprise a droplet magnetization, wherein said droplet magnetization is configured for droplet self-interaction by said magnetic elements and said active magnet, wherein said self-interaction comprises splitting, merging, propagation, logic, storage, memory and logical circuit operations.

2. The magnetic-hydrodynamic force fluid logic controller of claim 1, wherein said fluid under test comprises a single-phase fluid under test, a carrier fluid, or said single-phase fluid under test and said carrier fluid, wherein said active magnet is disposed to control said fluid under test.

3. The magnetic-hydrodynamic force fluid logic controller of claim 2, wherein said fluid test is selected from the group consisting of water-based ferrofluid, oil-based ferrofluid, fluid with magnetic beads, magnetic nanoparticles dispensed in a fluid, fluid with magnetic surfactant on said solid or flexible substrate surface, magnetic fluid, non-magnetic fluid, water, water coated with surfactants, silicon oil, fluoro-inert oil, and hydrocarbon oil.

4. The magnetic-hydrodynamic force fluid logic controller of claim 2, wherein said carrier fluid is non-ferric and said fluid under test is ferric, or said carrier fluid is ferric and said fluid under test is non-ferric, or said carrier fluid is non-ferric and said fluid under test comprises a multi-phase emulsion of i) a ferric outside fluid and a non-ferric inside fluid, or ii) a ferric inside fluid and a non-ferric outside fluid.

5. The magnetic-hydrodynamic force fluid logic controller of claim 1, wherein said fluid under test comprises droplets with volumes in a range from 1 nl to 100 μl.

6. The magnetic-hydrodynamic force fluid logic controller of claim 1, wherein said two dimensional distribution of magnetized domains comprises shapes selected from the group consisting of T-shape, I-shape, linear-shape, serpentine-5 shape, undulating width-shape, stepped-shape, zig-zag-shape, chevron-shape, and an arbitrary-shape.

7. The magnetic-hydrodynamic force fluid logic controller of claim 6, wherein said two dimensional distribution of magnetized domains are configured to operate said self-interaction to form operations selected from the group consisting of OR, AND, XOR, NAND, NOR, Full Adders, flip-flop memory elements, and cascaded logic elements.

8. The magnetic-hydrodynamic force fluid logic controller of claim 1, wherein said solid or flexible substrate surface comprises a flat surface or a non-flat surface.

9. The magnetic-hydrodynamic force fluid logic controller of claim 8, wherein said flat surface comprises a material selected from the group consisting of epoxy-based negative photoresist and silica.

10. The magnetic-hydrodynamic force fluid logic controller of claim 1, wherein said solid or flexible substrate comprises an electrically conductive material, wherein said electrically conductive material comprises copper or gold.

11. The magnetic-hydrodynamic force fluid logic controller of claim 1, wherein said fluid chamber comprises surfaces selected from the group consisting of hydrophobic, oleophobic, superhydrophobic, and superoleophobic surfaces.

12. The magnetic-hydrodynamic force fluid logic controller of claim 11, wherein said surfaces comprise material selected from the group consisting of Teflon, PDMS, fluorosilanes, silicon-based spray-on coating, fluorinated acrylate oligomers, and monomers.

13. The magnetic-hydrodynamic force fluid logic controller of claim 1, wherein said solid or flexible substrate comprises a material selected from the group consisting of silica, $SiO_2$, silicon wafer, plastic, metal and a non-magnetic solid or flexible material.

14. The magnetic-hydrodynamic force fluid logic controller of claim 1, wherein said magnetized domain comprises permalloy bars, or a magnetic material ranging in size from a 100 nm to 100 mm.

15. The magnetic-hydrodynamic force fluid logic controller of claim 1, wherein said active magnet forms a dynamic magnetic field selected from the group consisting of a rotating magnetic field, a varying magnitude magnetic field, an x-direction oscillating magnetic field, a y-direction oscillating magnetic field, an ON-OFF magnetic field, clocked magnetic field, a periodically varying magnetic field profile, and an aperiodically varying magnetic field profile.

16. The magnetic-hydrodynamic force fluid logic controller of claim 1, wherein said fluid chamber comprises fluid guides, wherein said fluid guides are selected from the group consisting of walls, channels, grooves, indentations, protrusions, and channels, wherein said fluid guides are disposed to provide hydrodynamic resistant inside said fluid chamber.

17. The magnetic-hydrodynamic force fluid logic controller of claim 1, wherein said fluid chamber comprises a fluid input port and a fluid output port, wherein i) said fluid under test, ii) said carrier fluid, or iii) said fluid under test and said carrier fluid are input through said input port and output through said output port.

18. The magnetic-hydrodynamic force fluid logic controller of claim 1, wherein said two-dimensional distribution of magnetized domains are disposed configured to i) collide a droplet of said fluid under test with another droplet of said fluid under test, or ii) to merge two droplets of said fluid under test, or iii) break a droplet of said fluid under test into at least two smaller droplets of said fluid under test, or iv)

to dispense a known amount of said fluid under test, or v) to dilute said fluid under test, or vi) to concentrate said fluid under test, or vii) to start chemical reactions in said fluid under test, or viii) to stop a chemical reaction of said fluid under test.

19. The magnetic-hydrodynamic force fluid logic controller of claim 1, wherein a plurality of said substrates, said fluid chambers and said magnetic elements are disposed in a stacked array forming a three dimensional manifold for said droplets.

* * * * *